US012742219B2

(12) United States Patent
Matschullat et al.

(10) Patent No.: US 12,742,219 B2
(45) Date of Patent: Sep. 22, 2026

(54) MAKING AN ALLOWANCE FOR STATE-DEPENDENT DENSITY WHEN SOLVING A HEAT CONDUCTION EQUATION

(71) Applicant: Primetals Technologies Germany GmbH, Erlangen (DE)

(72) Inventors: Thomas Matschullat, Eckental (DE); Klaus Weinzierl, Nuremberg (DE)

(73) Assignee: Primetals Technologies Germany GmbH (DE)

( * ) Notice: Subject to any disclaimer, the term of this patent is extended or adjusted under 35 U.S.C. 154(b) by 421 days.

(21) Appl. No.: 18/579,266

(22) PCT Filed: Jun. 21, 2022

(86) PCT No.: PCT/EP2022/066806
§ 371 (c)(1),
(2) Date: Jan. 12, 2024

(87) PCT Pub. No.: WO2023/285078
PCT Pub. Date: Jan. 19, 2023

(65) Prior Publication Data

US 2024/0344162 A1 Oct. 17, 2024

(30) Foreign Application Priority Data

Jul. 15, 2021 (EP) ..... 21185929

(51) Int. Cl.
*B21B 37/74* (2006.01)
*C21D 9/00* (2006.01)

(52) U.S. Cl.
CPC ..... *C21D 9/00* (2013.01); *B21B 37/74* (2013.01)

(58) Field of Classification Search
CPC ..... B21B 37/00; B21B 37/74; C21D 9/00
See application file for complete search history.

(56) References Cited

U.S. PATENT DOCUMENTS 6,860,950 B2 * 3/2005 Franz ..... C21D 11/005 148/661
7,449,140 B2 11/2008 Franz et al.
(Continued)

FOREIGN PATENT DOCUMENTS

CN 1463293 A 12/2003
CN 102473003 A 5/2012
(Continued)

OTHER PUBLICATIONS

International Search Report mailed September 23, 2022 in corresponding PCT International Application No. PCT/EP2022/066806.
(Continued)

*Primary Examiner* — Alvin H Tan
(74) *Attorney, Agent, or Firm* — OSTROLENK FABER LLP

(57) ABSTRACT

At a treatment time, a treatment device is intended to act, at least substantially in the thickness direction, on a planar, hot item of metal rolling stock. At least for a period before the treatment time, the development over time of a thermal state (Z) of the rolling stock is modelled by means of a model of the rolling stock by iteratively solving at least one thermal conductivity equation. The treatment device is controlled on the basis of the particular thermal state (Z) determined by the model for the rolling stock for the treatment time.

8 Claims, 9 Drawing Sheets

(56) References Cited

U.S. PATENT DOCUMENTS

| | | | |
|---|---|---|---|
| 7,865,341 | B2 | 1/2011 | Borchers et al. |
| 8,170,853 | B2 | 5/2012 | Franz et al. |
| 9,815,100 | B2 | 11/2017 | Weinzierl |
| 10,500,619 | B2 * | 12/2019 | Inami ..... B21B 37/74 |
| 11,701,696 | B2 | 7/2023 | Heimann et al. |
| 2004/0006998 | A1 | 1/2004 | Franz et al. |
| 2005/0016712 | A1 | 1/2005 | Franz et al. |
| 2022/0371066 | A1 | 11/2022 | Heimann et al. |

FOREIGN PATENT DOCUMENTS

| | | | |
|---|---|---|---|
| CN | 103619501 | A | 3/2014 |
| CN | 106166566 | A | 11/2016 |
| DE | 102019216261 | A1 | 1/2021 |
| EP | 1397523 | A1 | 1/2003 |
| EP | 1576429 | A1 | 5/2004 |
| EP | 1711868 | B1 | 5/2008 |
| EP | 1910951 | B1 | 1/2017 |
| JP | 2014-000593 | A | 1/2014 |
| WO | WO 2004042480 | A1 | 5/2004 |
| WO | WO 2005076092 | A1 | 8/2005 |
| WO | WO 2017092967 | A1 | 6/2017 |

OTHER PUBLICATIONS

Office Action dated Feb. 28, 2026 in corresponding Chinese Patent Application No. 202280049974.1. English translation of Search Report.

* cited by examiner

16

$$\frac{dH}{dt} = \frac{d}{ds}\left(\frac{\lambda}{\rho} \cdot \frac{dT}{ds}\right)$$

16

$$\frac{dH}{dt} = \frac{xL \cdot xB}{xD} \cdot \frac{d}{ds_0}\left(\frac{\lambda}{\rho_0} \cdot \frac{dT}{ds_0}\right)$$

16

$$\frac{dH}{dt} = \frac{1}{xD^2} \cdot \frac{d}{ds_0} \left( \frac{\lambda}{\rho} \cdot \frac{dT}{ds_0} \right)$$

MAKING AN ALLOWANCE FOR STATE-DEPENDENT DENSITY WHEN SOLVING A HEAT CONDUCTION EQUATION

CROSS-REFERENCE TO RELATED APPLICATIONS

The present application is a 35 U.S.C. §§ 371 national stage application of International Application No. PCT/EP2022/066806, filed Jun. 21, 2022, which claims priority to European Patent Application No. 21185929.3, filed Jul. 15, 2021, the contents of which are incorporated herein by reference.

TECHNICAL FIELD

The present invention is based on a treatment method for an item of metal rolling stock, wherein the rolling stock is a flat hot item of rolling stock which extends in a longitudinal direction, in a width direction and in a thickness direction,

- wherein at a treatment time, the rolling stock is acted on at least substantially in the thickness direction by means of a treatment device,
- wherein at least for a period before the treatment time, the temporal development of a thermal state of the rolling stock is modeled by means of a model of the rolling stock by iteratively solving at least one heat conduction equation,
- wherein control of the treatment device, taken as a basis for the treatment device to act on the rolling stock, is effected depending on that thermal state which is determined by means of the model for the rolling stock for the treatment time,
- wherein the density of the rolling stock influences the heat conduction equation,
- wherein the density is dependent on the respective thermal state of the rolling stock.

The present invention is furthermore based on a control program for a control device of a treatment device for treating an item of metal rolling stock, wherein the control program comprises machine code which is processable by the control device, wherein the processing of the machine code by the control device has the effect that the control device operates the treatment device in accordance with a treatment method of this type.

The present invention is furthermore based on a control device of a treatment device for treating an item of metal rolling stock, wherein the control device is programmed with a control program of this type, such that the control device operates the treatment device in accordance with a treatment method of this type.

The present invention is furthermore based on a treatment installation for treating an item of metal rolling stock, wherein the rolling stock is a flat hot item of rolling stock which extends in a longitudinal direction, in a width direction and in a thickness direction,

- wherein the treatment installation has a treatment device, by means of which the rolling stock is able to be acted on at least substantially in the thickness direction,
- wherein the treatment installation has a control device, by which at least the treatment device is controlled,
- wherein the control device is designed as a corresponding control device, such that the control device operates the treatment device in accordance with a treatment method of this type.

PRIOR ART

During the production of a flat item of rolling stock, i.e. in connection with casting, roughing, finish rolling and cooling, it is often necessary to accurately know the temperature or generally the thermal state of the flat rolling stock at specific times. A measurement of the temperature and thus the thermal state is not possible, however, in many cases. For this reason, the thermal state of the flat rolling stock is correspondingly modeled.

A heat conduction equation is often used for proper modeling. The heat conduction equation is a differential equation which needs to be solved iteratively in small temporal steps. The heat conduction equation can be formulated in various ways, depending on the procedure. Depending on the circumstances, it may furthermore be necessary also to iteratively solve a phase transformation equation in parallel with solving the heat conduction equation.

Heat conduction equations are known in various embodiments. In this regard, for example, it is known to formulate the heat conduction equation in one-dimensional or three-dimensional form. In the case of a one-dimensional formulation, the heat conduction equation is solved only in the thickness direction of the flat rolling stock. The heat flow in the longitudinal direction and in the width direction is disregarded. Some possible one-dimensional formulations for the heat conduction equation are presented and explained below—in the sense of an incomplete enumeration. The corresponding three-dimensional formulations are not concomitantly explained separately, but are concomitantly indicated (at least for the most part) in the prior art.

In this regard, for example, it is possible to formulate the heat conduction equation in the form $$\frac{\partial T}{\partial t} = \frac{\lambda}{\rho \cdot c_P} \cdot \frac{\partial^2 T}{\partial s^2}. \tag{1}$$

In this case, T is the temperature, $\lambda$ is the thermal conductivity, $\rho$ is the density and $c_P$ is the heat capacity of the rolling stock. t and s are the time and the location in the thickness direction of the rolling stock. This formulation is explained for example in the reference book "Einfuhrung in partielle Differenzialgleichungen" ["Introduction to partial differential equations" ] by Aslak Tveito and Ragnar Winther, Springer-Verlag 2002. This formulation is linear and based on temperature and works without heat sources.

If the heat capacity is alternatively formulated as temperature-dependent, equation 1 is rewritten as follows:

$$\rho \cdot c_P(T) \cdot \frac{\partial T}{\partial t} = \frac{\partial}{\partial s}\left(\lambda(T) \cdot \frac{\partial T}{\partial s}\right) \tag{2}$$

The difference with respect to equation 1 is that the heat capacity $c_P$ is now temperature-dependent and thus indirectly variable over time and a nonlinear behavior of the rolling stock can be modeled. The thermal conductivity may be state-dependent. This formulation is likewise explained in the cited reference book by Aslak Tveito and Ragnar Winther. It is nonlinear and likewise based on temperature.

Alternatively, for example, it is possible to formulate the heat conduction equation in the form $$\rho \cdot \frac{\partial H}{\partial t} = \frac{\partial}{\partial s}\left(\lambda(H, p) \cdot \frac{\partial T(H, p)}{\partial s}\right) + Q(s). \tag{3}$$

In this case—in addition to the variables already explained—H is the enthalpy and p is a phase state. The phase state may be scalar or vectorial. Heat sources or heat sinks are modeled with Q. This formulation is explained for example in EP 1 397 523 A1, EP 1 576 429 A1 and EP 1 711 868 B1. This formulation is nonlinear and works with the enthalpy and the phase transformation and also with sources. The temperature is a variable derived from the enthalpy and the phase state. An allowance may likewise be made for heat sources and heat sinks in this formulation.

The last-mentioned formulation may be extended to the effect that in addition an allowance is concomitantly made for the concentration of a dissolved alloying element in a phase (in particular the concentration of carbon in the austenite phase in the case of steel). This procedure is explained in detail in EP 1 910 951 B1.

As a final example, mention shall also be made of the formulation that involves formulating the heat conduction equation in the form $$\rho \cdot c_P \cdot \frac{\partial T}{\partial t} - \frac{\partial}{\partial s}\left(\lambda \cdot \frac{\partial T}{\partial s}\right) = Q. \tag{4}$$

The associated variables have already been explained. This formulation is mentioned for example in WO 2017/092 967 A1. WO 2017/092 967 A1 furthermore explains that a density can be determined for each of the individual phases, phase boundaries between the phases can be determined and a density distribution can be determined on the basis of the determined densities and the determined phase boundaries. The accurate knowledge of the density distribution is intended to enable the temperature distribution to be determined more accurately.

The paper "Calculation of Thermophysical Properties of Carbon and Low Alloyed Steels for Modeling of Solidification Prozesses" by Jyrki Miettinen and Seppo Louhenkilpi, Metallurgical and Materials Transactions, Volume 25B, December 1994, pages 909 to 916, likewise mentions various heat conduction equations in connection with solidification processes. The density is formulated as a state-dependent variable. Specifically, it is determined in accordance with the relationship $$\rho = \frac{1}{\sum \frac{f_i}{\rho_i}}. \tag{5}$$

In this case, ρ—as above—is the density, $f_i$ are components of phases and $\rho_i$ are the densities of the phases.

SUMMARY OF THE INVENTION

Irrespective of the heat conduction equation specifically used, the density (inter alia) always influences the heat conduction equation. This holds true irrespective of whether one of the formulations explained above or a different formulation is used for the heat conduction equation. It also holds true irrespective of whether the heat conduction equation is formulated in one-dimensional or multidimensional form, and irrespective of whether the heat conduction equation is formulated in linear or nonlinear form.

By far the most formulations assume that the density of the material does not change, and so the density can be formulated as a constant in the context of solving the heat conduction equation. WO 2017/092 967 A1 does mention that the density can be formulated as a variable. However, no explanations at all are given as to how an allowance ought to be made for this variable density in the heat conduction equation. The formulation by Miettinen and Louhenkilpi applies only specifically to solidification processes and is not applicable to rolling stock in which the metal has already solidified. The reason for this is that a change in density in a solid always entails a change in the dimensions thereof, and an allowance must be made for this, just like for the change in density itself, in the discretization of the heat conduction equation. In the cited paper, by contrast, in particular a change in the thickness direction is prevented by rollers bearing against the rolling stock.

The object of the present invention is to provide possibilities by means of which an allowance can be correctly made for the state-dependent density of the rolling stock and the accuracy when solving the heat conduction equation can thus be improved.

The object is achieved by an operating method as claimed. The dependent claims relate to advantageous embodiments of the operating method.

According to the invention, a treatment method of the type mentioned in the introduction is embodied by the fact that an allowance is made for the dependence of the density of the rolling stock on the respective thermal state of the rolling stock in the heat conduction equation by a factor of the form $$a = \frac{xL \cdot xB}{xD \cdot \rho_0} \text{ or } a' = \frac{1}{xD^2 \cdot \rho}, \tag{6}$$

wherein ρ and $\rho_0$ are densities of the rolling stock related to a current and a predetermined thermal state of the rolling stock and the coefficients xL, xB and xD arise as a quotient of an extent of the rolling stock in the longitudinal direction, in the width direction and in the thickness direction in the case of the respective and the predetermined thermal state of the rolling stock.

The factor a or a' enables an allowance to be made completely for the dependence of the heat conduction equation on the density of the rolling stock. Over and above the factor a or a', the heat conduction equation is thus independent of the density of the rolling stock.

The factors a and a' will be derived later for a very specific heat conduction equation. However, they are totally independent of the heat conduction equation specifically used. In other words, each of equations 1 to 4 can be used, including in their multidimensional form. Likewise, other heat conduction equations can also be used. Moreover, it is possible, if necessary, to solve the heat conduction equation used with simultaneous coupling to a phase transformation equation and thereby to make an allowance for the transformation heat that occurs during the phase transformation.

In the general case, the coefficients xL, xB and xD need to be known individually and specifically. The density is often isotropic, however. In this case, changes in density are isotropic as well. Consequently, only the density as such need be known. This is because in this case it is possible to determine the coefficients xL, xB and xD in such a way that they are mutually equal in magnitude and their product is equal to the quotient of the density dependent on the respective thermal state of the rolling stock and the normalized density related to the predetermined thermal state of the rolling stock. Owing to the equality of the coefficients xL, xB and xD, the factor a can thus be simplified as $$a = \frac{xD}{\rho_0}. \tag{7}$$

Of course (owing to the equality), the coefficient xL or the coefficient xB or the cube root of the change in density could likewise be used instead of the coefficient xD.

In the case where the factor a' is used, it is only necessary to determine the coefficient xD. In this case, the coefficient xD can be determined in such a way it is equal to the cube root of the quotient of the density dependent on the respective thermal state of the rolling stock and the normalized density related to the predetermined thermal state of the rolling stock.

In some cases, it may be sufficient for the modeling of the temporal development of the thermal state of the rolling stock to be carried out offline. Generally, however, the modeling of the temporal development of the thermal state of the rolling stock is effected online—for example in the context of a setup calculation—or even in real time.

The type of treatment may be as required. For example, it is possible that rolling of the rolling stock is effected by means of the treatment device, such that the thickness of the rolling stock after the treatment device has acted on the rolling stock is smaller than before the treatment device has acted on the rolling stock. In this case, the thermal state of the rolling stock that is determined by means of the model can be used for example in the context of determining the conversion resistance of the rolling stock and thus determining the required rolling force.

Purely thermal influencing of the rolling stock without conversion of the rolling stock is often effected by means of the treatment device. Such thermal influencing of the rolling stock may be, as required, for example heating (for example inductive heating) upstream of a roughing train or upstream of a finishing train. Moreover, it may also involve action in which cooling occurs as an unavoidable secondary effect, for example during the descaling of the rolling stock. Primarily, however, it may involve intentional cooling. Examples that may be mentioned in this context include intermediate stand cooling (i.e. cooling between individual rolling processes in a multi-stand rolling train) or cooling in a cooling section disposed downstream of a rolling device.

The object is furthermore achieved by a control program as claimed. According to the invention, the processing of the control program has the effect that the control device operates the treatment device in accordance with a treatment method according to the invention.

The object is furthermore achieved by a control device as claimed. According to the invention, the control device is programmed with a control program according to the invention, such that the control device operates the treatment device in accordance with a treatment method according to the invention.

The object is furthermore achieved by a treatment installation as claimed. According to the invention, the control device is designed as a control device according to the invention, such that the control device operates the treatment device in accordance with a treatment method according to the invention.

Kurze Beschreibung der Zeichnungen

The above-described properties, features and advantages of the present invention and the manner in which they are achieved will become clearer and more easily understandable in connection with the following description of the exemplary embodiments, which are explained in more detail in association with the drawings, in which, in a schematic illustration:

DESCRIPTION OF THE EMBODIMENTS

Figure 1:
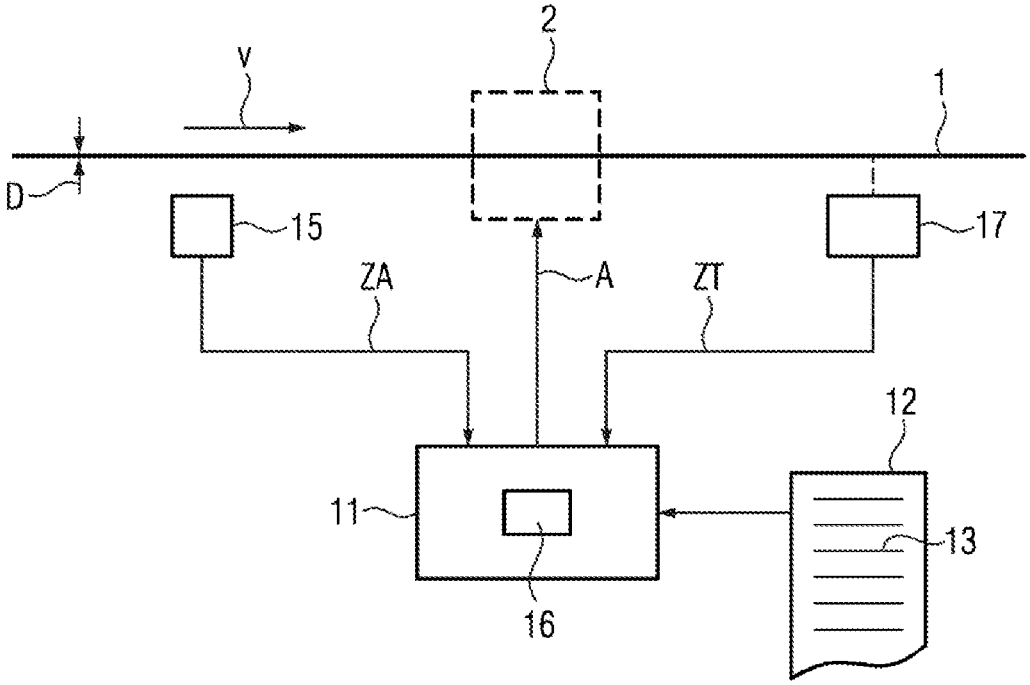
FIG. 1 shows a treatment installation from the side.

In accordance with FIG. 1, a treatment installation for rolling stock 1 has a treatment device 2. The rolling stock 1 can be acted on by means of the treatment device 2.

The rolling stock 1 consists of metal. The rolling stock 1 usually consists of steel. However, it can also consist of a different metal, for example aluminum or copper. The rolling stock 1 extends—see FIG. 2—in a longitudinal direction over a total length L and in a width direction over a total width B. furthermore, the rolling stock 1 also extends in a thickness direction—see FIG. 1—over a thickness D. The thickness D is smaller than the width B, usually considerably smaller. The width B is usually smaller than the length L. Typical values for the thickness D are in the range of from less than 1 mm to 250 mm, sometimes also somewhat more than that. Typical values for the width B are in the range of between 500 mm and 2500 mm, in some cases even somewhat more than that. The length L is quite a few meters, for example several 100 m or even up to more than 1000 m. The rolling stock 1 is thus a flat item of rolling stock 1. Furthermore, the rolling stock 1 is a hot item of rolling stock 1.

The rolling stock 1 can be acted on at least substantially in the thickness direction by means of the treatment device 2. This is explained in more detail below in association with FIG. 3.

Figure 3:
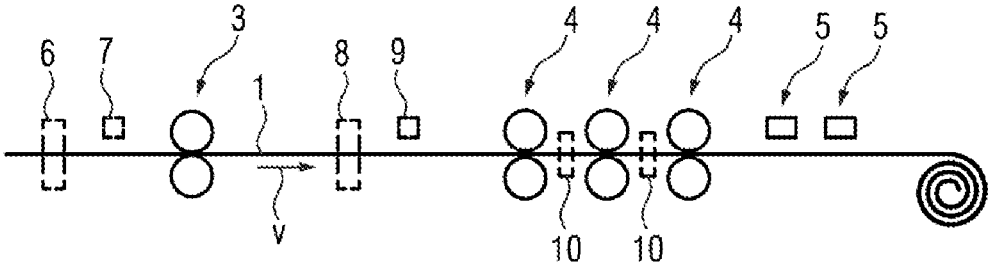
FIG. 3 shows a hot rolling installation including cooling section.

In accordance with FIG. 3, the rolling stock 1 can firstly be roughed in a roughing mill, then be finish rolled in a finishing train, then be cooled in a cooling section disposed downstream of the finishing train, and finally be wound to form a coil. The roughing mill has at least one roughing stand 3 for roughing the rolling stock 1. Analogously, the finishing train for finish rolling the rolling stock 1 has at least one finish rolling stand 4. The cooling section has at least one application device 5 that can be used to apply cooling water to the rolling stock 1.

A heating device 6 (in particular induction heating) and/or a descaling device 7 can be disposed upstream of the roughing mill. Analogously, a heating device 8 (in particular induction heating) and/or a descaling device 9 can be disposed upstream of the finishing train. In the case of a multi-stand finishing train, intermediate stand cooling facilities 10 can furthermore be arranged between the finish rolling stands 4 and be used to apply cooling water to the rolling stock 1 between the individual finish rolling stands 4.

Each of the components 3 to 10 mentioned can be a treatment device 2 in the sense of the present invention. In the case of the rolling stands 3, 4, the rolling stock 1 is rolled. In this case, the thickness D of the rolling stock 1 after the treatment device 2, 3, 4 has acted on the rolling stock 1 is very generally smaller than before the treatment device 2, 3, 4 has acted on the rolling stock 1. Equality is given merely as an exception if the rolling stock 1 passes through the treatment device 2, 3, 4 without conversion. In the case of the application device 5, the heating devices 6, 8, the descaling devices 7, 9 and the intermediate stand cooling facilities 10, the action of the treatment device 2, 5 to 10 on the rolling stock 1 results in purely thermal influencing of the rolling stock 1 without conversion. In the case of the heating devices 6, 8, the purely thermal influencing is heating up of the rolling stock 1. In the case of the application devices 5, the descaling devices 7, 9 and the intermediate stand cooling facilities 10, the purely thermal influencing is cooling of the rolling stock 1.

Hereinafter the reference sign used for the treatment device will only ever be the reference sign 2. Complete listing of the reference signs 2, 3, 4 etc. would only bloat the text and make it less understandable, without contributing to the understanding of the present invention.

In accordance with FIG. 1, the treatment device 2 (and, if appropriate, also further components of the treatment installation) are controlled by a control device 11. The control device 11 is programmed with a control program 12. The control program 12 comprises machine code 13 that is executable by the control device 11. The programming of the control device 11 with the control program 12 (or equivalently thereto the processing of the machine code 13 by the control device 11) has the effect that the control device 11 operates the treatment device 2 in accordance with a treatment method such as is explained in more detail below—firstly in association with FIG. 4.

Figure 4:
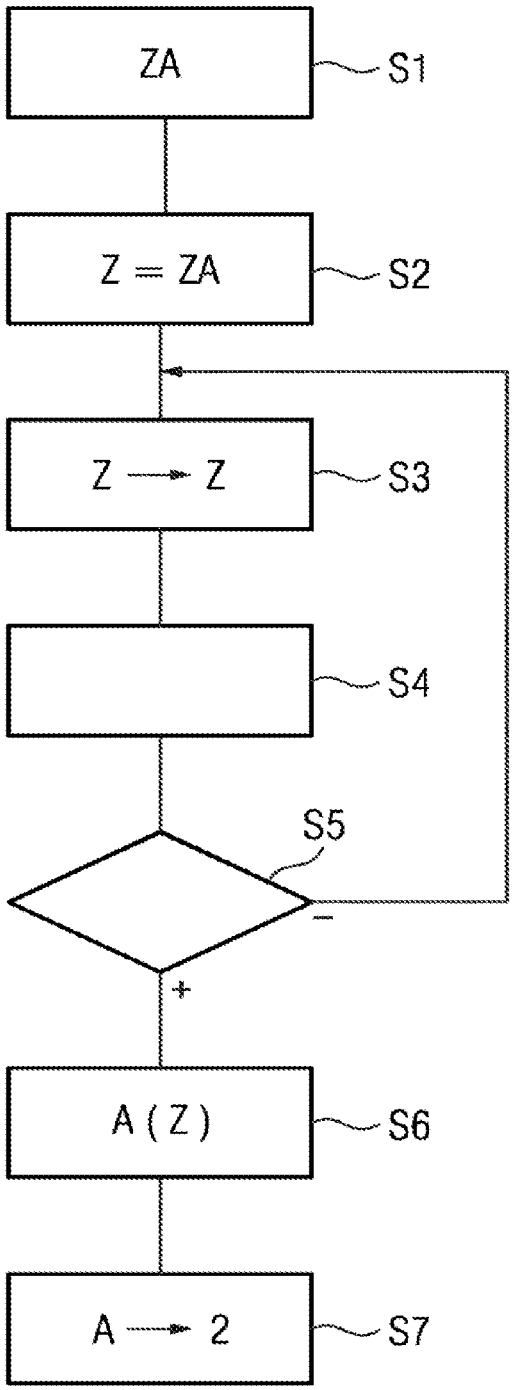
FIG. 4 shows a flow diagram.

In accordance with FIG. 4, in a step S1, an initial state ZA of the rolling stock 1 is known to the control device 11. Under certain circumstances, the initial state ZA can relate to the entire rolling stock 1. Alternatively, it can relate to an individual portion 14 of the rolling stock 1—see FIG. 2. It is assumed below that the initial state ZA relates to an individual portion 14 of the rolling stock 1. This also constitutes the general case since, in the case of a uniform consideration of the entire rolling stock 1, it is merely necessary for the number of portions 14 to be reduced accordingly, namely to a single portion 14.

A thermal state of the portion 14 is determined by the initial state ZA. In particular, at least the initial temperature T of the corresponding portion 14 is determined—directly or indirectly—by said initial state. If appropriate, a phase state p may additionally be determined as well. By way of example, the initial state ZA may contain the initial temperature or the initial enthalpy of the portion 14, specifically in both cases with or without phase components or at least one phase component.

Figure 2:
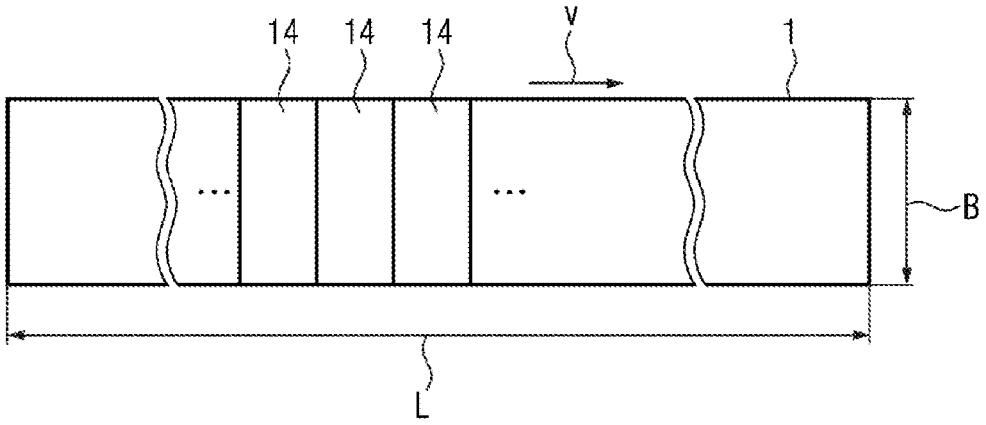
FIG. 2 shows a flat item of rolling stock from above.

By way of example, according to the illustration in FIGS. 1 to 3, the rolling stock 1 may be conveyed at a constant or variable velocity v, the velocity v progressing in the longitudinal direction of the rolling stock 1. In this case, for example, by means of a corresponding measuring device 15 (for example by means of a temperature measuring station) with a fixed timing cycle, the respective initial state ZA can be detected and fed to the control device 11. In this case, the control device 11 assigns the initial state ZA to the corresponding portion 14. However, other procedures are also possible. In the case of a fixed timing cycle, the length of the respective portion 14 to which the respective initial state ZA relates is determined by the velocity v during the respective timing cycle and the timing cycle itself. The timing cycle is typically between 0.1 s and 0.5 s, in particular between 0.2 s and 0.4 s, for example 0.3 s.

In a step S2, the control device 11 sets a current state Z of the portion 14 to be equal to the initial state ZA. The current state Z, too, is therefore a thermal state.

In a step S3, the control device 11 updates the current state Z of the portion 14. In particular, in the step S3, in a model 16 of the rolling stock 1 (see FIG. 1), the control device 11 formulates at least one heat conduction equation for the portion 14 and solves the heat conduction equation for an individual time step. This will be explained in still more detail later. If necessary, in the step S3, the control device 11 can additionally also formulate and solve a phase transformation equation for the portion 14.

If necessary, in a step S4, the control device 11 implements path tracking for the portion 14. Path tracking and the implementation thereof are generally known to those skilled in the art.

In a step S5, the control device 11 checks whether the treatment time has been reached at which the portion 14 of the rolling stock 1 is intended to be treated in the treatment device 2, i.e. the portion 14 is intended to be acted on in the thickness direction by the treatment device 2. For clarification: The treatment time is not a time period detached from an absolute time, but rather a fixed point in time or a fixed time period. In other words, the term "treatment time" does not have the meaning that the portion 14 is intended to be acted on in the treatment device 2 for—for example—5 s, independently of when this occurs. Rather, the term "treatment time" has the meaning that the portion 14 is intended to be acted on at a specific point in time—for example exactly at 13:39:22—or the portion 14 is intended to be acted on starting from the specific point in time for a predetermined time period—for example for 5 s—in the treatment device 2.

If the treatment time has not yet been reached, the control device 11 returns to the step S3. By contrast, if the treatment time has been reached, the control device transitions to a step S6.

In the step S6, the control device 11 determines a control A for the treatment device 2 depending on the current state Z that was determined for the treatment time by means of the model 16 for the portion 14. In the case of a rolling process, when determining the control A an allowance can concomitantly be made for example for the material strength of the portion 14 such as results (inter alia) from the current state Z. In the case of purely thermal influencing, the extent of the influencing—for example the amount of coolant that is intended to be applied to the portion 14—can be determined depending on the current state Z.

In a subsequent step S7, the control device 11 controls the treatment device 2 according to the control A determined. On account of the control A, the treatment device 2 acts on the rolling stock 1 in the thickness direction.

As a result, by way of the procedure in FIG. 4, therefore, at least for a period before the treatment time, the temporal development of the current state Z of the rolling stock 1 is modeled by means of the model 16 by iteratively solving at least one heat conduction equation. If necessary, as already mentioned, a phase transformation equation can simultaneously also be solved iteratively and with mutual coupling to the heat conduction equation.

Figure 5:
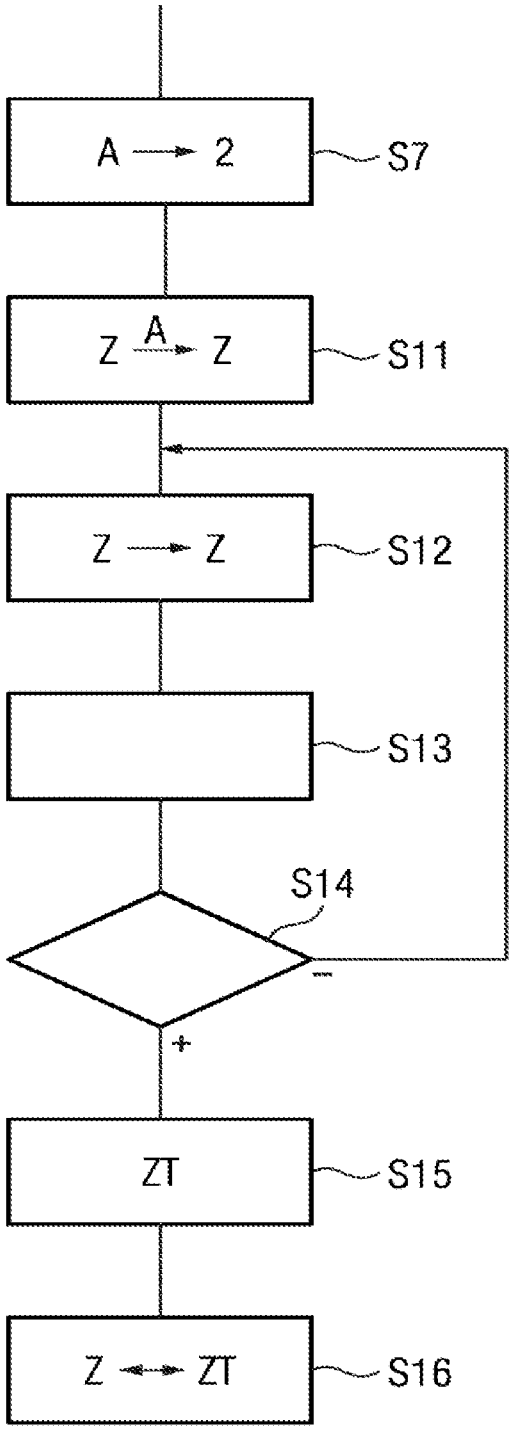
FIG. 5 shows a flow diagram.

In many cases, the procedure in FIG. 4 is supplemented according to FIG. 5. In this case, the step S7, in which the portion 14 is acted on, is followed by steps S11 to S16.

In the step S11, the control device 11 updates the current state Z of the portion 14 according to the control A.

In a step S12, the control device 11 updates the current state Z. The step S12 corresponds to the step S3 in terms of contents. Furthermore, if necessary, in a step S13, the control device 11 implements path tracking for the corresponding portion 14.

In a step S14, the control device 11 checks whether the portion 14 has reached a detection location at which an actual thermal state ZT of the portion 14 is detected by means of a further measuring device 17. The measuring device 17 can be a temperature measuring station, for example.

If the detection location has not yet been reached, the control device 11 returns to the step S12. By contrast, if the detection location has been reached, the control device transitions 11 to a step S15. In the step S15, the control device 11 receives the actual thermal state ZT of the portion 14. In a step S16, the control device 11 then compares the current state Z determined last with the actual thermal state ZT detected metrologically. On the basis of the comparison, the control device 11 implements further measures in the step S16. For example, it may adapt the model 16 or readjust the control A in the sense of setpoint-actual closed-loop control.

Figures 6, 7:
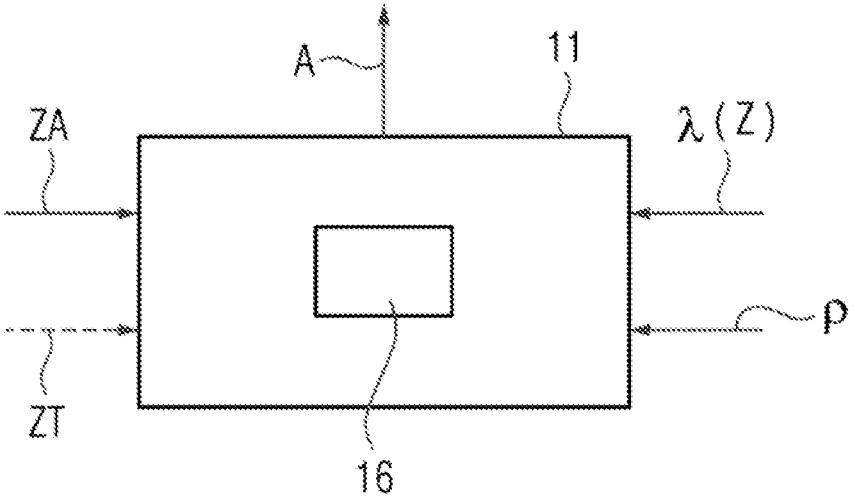
FIG 6 (Prior art)
FIG 7 (Prior art)
FIG. 6 shows a heat conduction equation.
FIG. 7 shows a control device.

In the case of the procedures in the prior art, as a heat conduction equation that is solved in the steps S3 and S12, for example according to the illustration in FIG. 6, in the model 16 it is possible to formulate an equation of the form $$\frac{dH}{dt} = \frac{d}{ds}\left(\frac{\lambda}{\rho} \cdot \frac{dT}{ds}\right). \tag{8}$$

In equation 8, H is the enthalpy (or energy density), t is time, s is the spatial variable in the thickness direction, $\lambda$ is the thermal conductivity, $\rho$ is the density and T is the temperature.

The arguments of the variables are not concomitantly indicated in equation 8 since they are not important in the context of the present invention. The present invention is explained below in association with the formulation in accordance with equation 8. However, the procedure according to the invention is also valid for other heat conduction equations, irrespective of the formulation made.

As is evident, the heat conduction equation is influenced by the density $\rho$ and the thermal conductivity $\lambda$ of the rolling stock 1. The thermal conductivity $\lambda$ is generally dependent on the respective thermal state Z of the rolling stock 1 (or of the corresponding portion 14). Therefore, in accordance with FIG. 7, the thermal conductivity $\lambda$ for a large number of possible thermal states Z is fed to the control device 11. The density $\rho$ is assumed to be constant and is therefore fed as a constant to the control device 11. This procedure is known in the prior art and is not (yet) the subject matter of the present invention. This procedure is entirely satisfactory when accuracy requirements are not all that high.

As is generally known, however, the density $\rho$ is not constant, but rather varies at least depending on the temperature, often also depending on the phase state p. Therefore, just like the thermal conductivity $\lambda$, the density $\rho$ is dependent on the respective thermal state Z of the rolling stock 1. The fact that no allowance is made for the variability of the density $\rho$ in equation 8 leads to inaccuracies in the modeling. The—at least substantial—compensation of these inaccuracies is the subject matter of the present invention.

If the rolling stock 1 has a predetermined thermal state Z0, the rolling stock 1 has a specific density $\rho_0$. This density $\rho_0$ is referred to hereinafter as the normalized density. If the current state Z of the rolling stock 1 deviates from the predetermined thermal state Z0, then the current density $\rho$ of the rolling stock 1 usually also deviates from the normalized density $\rho_0$ of the rolling stock 1. The deviation can be described by a value x, wherein x is defined as $$x = \frac{\rho_0}{\rho}. \tag{9}$$

The change in density $\rho$ corresponds to a change in volume. For the length L, the width B and the thickness D of the rolling stock 1, therefore, the following relationships arise:

$$L = xL \cdot L_0 \tag{10}$$

$$B = xB \cdot B_0 \tag{11}$$

$$D = xD \cdot D_0 \tag{12}$$

wherein L, B and D are the length, the width and the thickness of the rolling stock 1 for the respective state Z and $L_0$, $B_0$ and Do are the length, the width and the thickness of the rolling stock 1 for the predetermined thermal state Z0. The variables related to the predetermined thermal state Z0 are referred to hereinafter as the normalized length, normalized width and normalized thickness.

Since the mass of the rolling stock 1 does not change and the density $\rho$ is defined as a quotient of mass and volume, the relationship $$x = xL \cdot xB \cdot xD \tag{13}$$

must furthermore necessarily hold true.

The changes particularly in the thickness D, but also in the length L and the width B, are associated with the following problem: The heat conduction equation is solved in practice for predetermined support points. The support points are specified once and are at specific (small) distances $ds_0$ from one another particularly in the thickness direction in the specification. As the density $\rho$ changes, however, the position of the support points changes as well. Therefore, the distances ds between the support points change as well. The distances ds would therefore need to be updated with each renewed determination of the state Z. This proves to be unwieldy in practice. The modeling is simplified considerably if the distances $ds_0$ can be maintained uniformly, i.e. the distance $ds_0$ is used throughout the calculation. This has effects on the heat conduction equation.

In order to explain the effects on the heat conduction equation, a small volume element 18 is considered below, i.e. a volume element 18 which, in accordance with FIG. 8 (see on the left therein), has the normalized length $L_0$, the normalized width $B_0$ and the normalized thickness $ds_0$. In the currently considered state Z, by contrast, the volume element 18 (see on the right in FIG. 8) actually has the length L, the width B and the thickness ds.

In order that the support points at which the heat conduction equation is solved can be maintained unchanged irrespective of the state Z respectively considered, a (geometric) transformation of the considered volume element 18 from the normalized dimensions $L_0$, $B_0$ and $ds_0$ to the dimensions L, B, ds is carried out. In order to be able to carry out this transformation, the heat conduction equation has to be suitably adapted. For determining this adaptation, various variables are mentioned below, which with the index "0" relate to the normalized dimensions $L_0$, $B_0$ and $ds_0$ of the volume element 18 and without the index "0" relate to the actual dimensions L, B, ds of the volume element 18. For the sake of brevity, instead of the wording "related to the normalized dimensions $L_0$, $B_0$, $ds_0$" and "related to the dimensions L, B, ds", use is made below just of the wording "in the untransformed state" and "in the transformed state", for short.

As a result of the geometric transformation, firstly there is no change in the energy density H (unit: J/kg). It thus holds true that $$H = H_0 \tag{14}$$

As a result of the geometric transformation, there is furthermore no change in the temperature T. It thus holds true that $$T = T_0 \tag{15}$$

On account of the geometric transformation, however, the thickness ds changes according to the coefficient xD. Therefore, the temperature gradient changes as well. It thus holds true that $$\frac{dT}{ds} = \frac{1}{xD} \cdot \frac{dT}{ds_0} \tag{16}$$

Furthermore, the change in density ρ influences the thermal conductivity λ. For physical reasons—at least for small changes in the density ρ—there must be a proportionality. It thus holds true that $$\lambda = \frac{\lambda_0}{x} \tag{17}$$

The heat flow density j is the product of thermal conductivity λ and temperature gradient. It thus holds true that $$j = \lambda \cdot \frac{dT}{ds} = \frac{\lambda_0}{x} \cdot \frac{dT}{xD \cdot ds_0} = \frac{1}{x \cdot xD} \cdot \lambda_0 \cdot \frac{dT}{ds_0} = \frac{1}{x \cdot xD} \cdot j_0 \tag{18}$$

Inserting the transformed variables into the heat conduction equation thus yields $$\frac{dH_0}{dt} = \frac{dH}{dt} = \frac{d}{xD \cdot ds_0}\left(\frac{x \cdot \lambda_0}{x \cdot \rho_0} \cdot \frac{dT}{xD \cdot ds_0}\right) = \frac{1}{xD^2} \frac{d}{ds_0}\left(\frac{\lambda_0}{\rho_0} \cdot \frac{dT}{ds_0}\right) \tag{19}$$

Figures 8, 9:
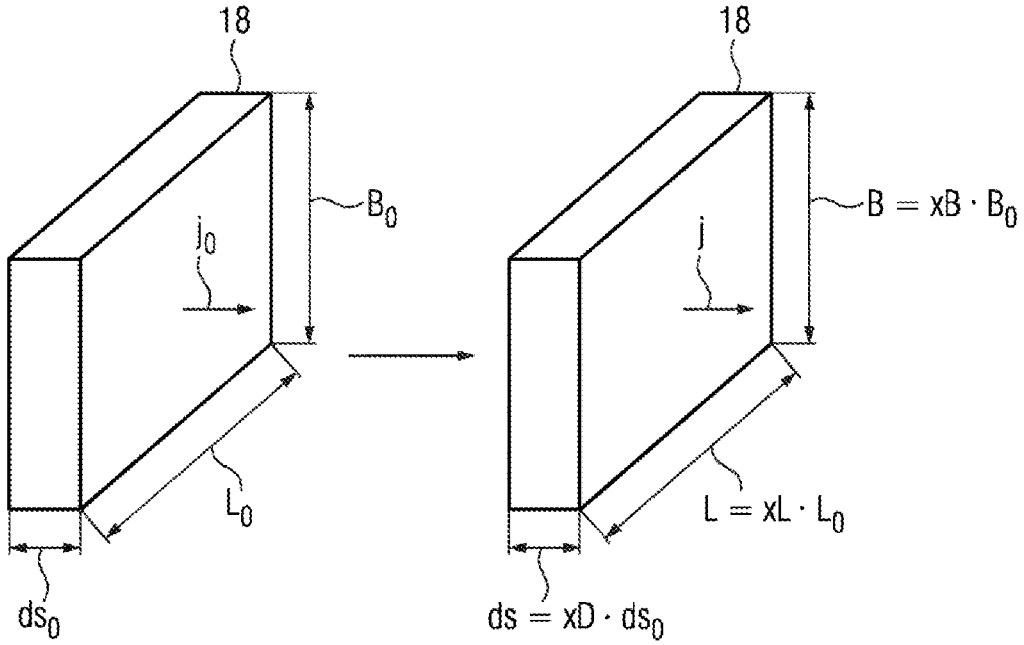
FIG. 8 shows a volume element.
FIG. 9 shows a heat conduction equation.

In practice, in accordance with FIG. 9 (and also already in accordance with FIG. 7) the thermal conductivity λ is specified as a function of the state Z for the control device 11. Therefore, the control device 11 does not "know" the thermal conductivity $\lambda_0$ in the untransformed state, but rather the thermal conductivity λ in the transformed state. On the basis of equation 17, this gives rise to—see also FIG. 9—the equation $$\frac{dH_0}{dt} = \frac{dH}{dt} = \frac{d}{xD \cdot ds_0}\left(\frac{x \cdot \lambda}{\rho_0} \cdot \frac{dT}{xD \cdot ds_0}\right) = \frac{xL \cdot xB}{xD} \cdot \frac{d}{ds_0}\left(\frac{\lambda}{\rho_0} \cdot \frac{dT}{ds_0}\right) \tag{20}$$

This is a heat conduction equation which is derived from equation 8 and in which an allowance is made correctly for the dependence of the density ρ on the current state Z and which can accordingly be solved in the steps S3 and S12.

In order to make an allowance for the state-dependent density p, therefore, the density ρ dependent on the current state Z must not simply be inserted into the otherwise unchanged heat conduction equation. Rather, additional corrections have to be carried out. By way of example, according to equation 20, a normalized density $\rho_0$—i.e. the density $\rho_0$ related to the predetermined thermal state Z0—can be used in the calculation and an allowance can be made for the influence of the density ρ dependent on the state Z through the use of a factor a dependent on the current state Z, wherein the factor a arises as $$a = \frac{xL \cdot xB}{xD \cdot \rho_0}. \tag{21}$$

Figure 10:
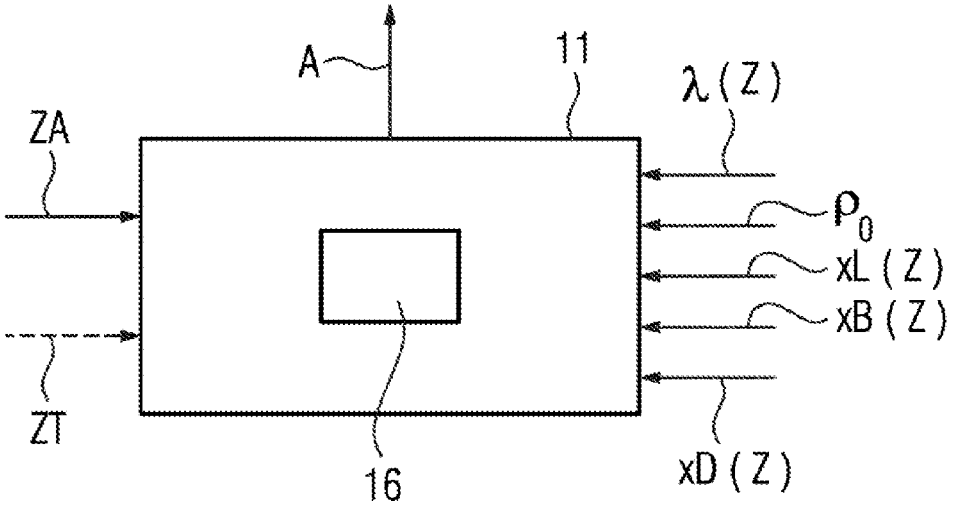
FIG. 10 shows a modification of the control device.

In practice, it is therefore possible to specify for the control device 11, in accordance with FIG. 10, in addition to the thermal conductivity λ (which is dependent on the current state Z) the normalized density $\rho_0$ and also the coefficients xL, xB and xD (which are likewise dependent on the current state Z). The thermal conductivity λ and the coefficients xL, xB and xD are specified for example for previously defined states between which interpolation is carried out. This is generally known to those skilled in the art and need not be explained in detail. The normalized density $\rho_0$ and the coefficients xL, xB and xD implicitly also give the density ρ dependent on the current state Z, even if the density ρ dependent on the current state Z is no longer required for solving the heat conduction equation itself.

Figure 11:
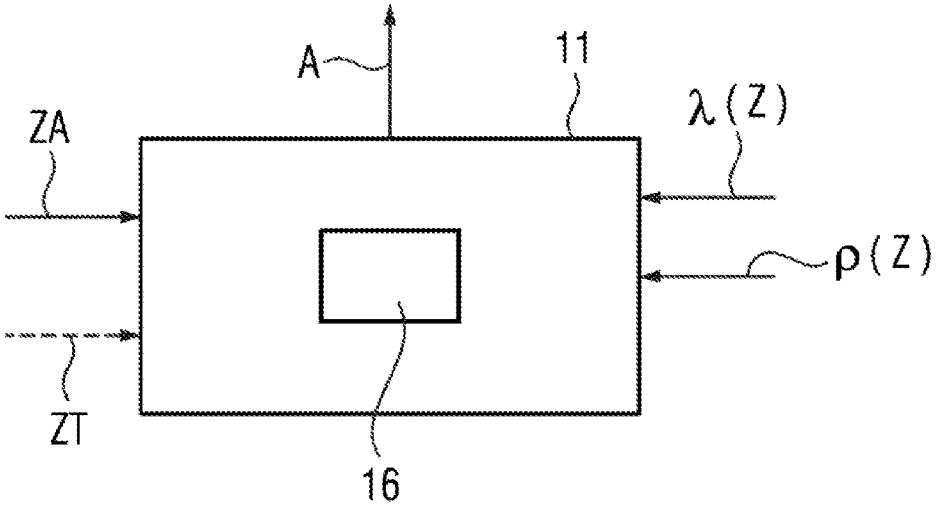
FIG. 11 shows a further modification of the control device.
Figures 12, 13:
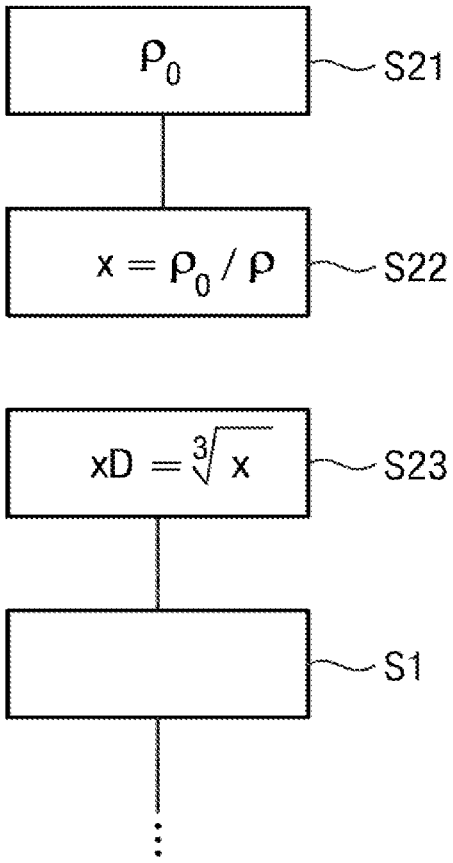
FIG. 12 shows a flow diagram.
FIG. 13 shows a heat conduction equation.

In practice, the rolling stock 1 often behaves isotropically. This does not just hold true, but for the density ρ as well. In this case, it is possible to specify for the control device 11, in accordance with FIG. 11, in addition to the thermal conductivity λ (which is dependent on the current state Z) the density ρ (which is likewise dependent on the current state Z). In this case, according to the illustration in FIG. 12 (for example before steps S1 to S7 are carried out), firstly in a step S21, the control device 11 can independently determine the normalized density $\rho_0$. By way of example, the control device 11 can determine as the normalized density $\rho_0$ among the specified densities ρ the largest density ρ, the smallest density ρ or a value between the largest density and the smallest density ρ. In a step S22, the control device 11 can then determine the corresponding value x by forming the quotient according to equation 9 for the respective state Z. Furthermore, since the product of the coefficients xL, xB and xD in accordance with equation 13 must be equal to the value x and the coefficients xL, xB and xD must have the same value among one another on account of the isotropy, finally in a step S23, the control device 11 can also determine the coefficient xD (and likewise also the coefficients xL and xB).

Owing to the equality of the coefficients xL, xB and xD, the heat conduction equation solved in steps S3 and S12 can furthermore be simplified as $$\frac{dH_0}{dt} = \frac{dH}{dt} = \frac{d}{xD \cdot ds_0}\left(\frac{x \cdot \lambda}{\rho_0} \cdot \frac{dT}{xD \cdot ds_0}\right) = xD \cdot \frac{d}{ds_0}\left(\frac{\lambda}{\rho_0} \cdot \frac{dT}{ds_0}\right). \tag{22}$$

The factor a is thus simplified as $$a = \frac{xD}{\rho_0} \tag{23}$$

If the rolling stock 1 behaves isotropically, in the case of the embodiment in accordance with FIG. 10 it is furthermore not necessary to specify the coefficients xL, xB and xD individually. Rather, since the coefficients xL, xB and xD are equal in magnitude among one another given an isotropic behavior, it is sufficient to specify an individual one of the coefficients xL, xB and xD.

Instead of the density $\rho_0$ related to the predetermined thermal state Z0, it is also possible to use the density ρ dependent on the current state Z. In this case, equation 20 (see also FIG. 13) is transformed by insertion of equation 9 to give $$\frac{dH_0}{dt} = \frac{dH}{dt} = \frac{d}{xD \cdot ds_0}\left(\frac{\lambda}{\rho} \cdot \frac{dT}{xD \cdot ds_0}\right) = \frac{1}{xD^2} \cdot \frac{d}{ds_0}\left(\frac{\lambda}{\rho} \cdot \frac{dT}{ds_0}\right) \tag{24}$$

Equation 24 is very similar to equation 19, but not identical to equation 19. The difference is that the untransformed thermal conductivity $\lambda_0$ and the normalized density $\rho_0$ of the predetermined state are used in equation 19, while the thermal conductivity λ and the density ρ such as are specified for the control device 11 are used in equation 24.

As an alternative to the use of the normalized density $\rho_0$, the actual density ρ dependent on the state Z can thus also be used in the calculation if an allowance is additionally made for a factor a' dependent on the current state Z, wherein the factor a' arises as $$a' = \frac{1}{xD^2 \cdot \rho}. \tag{25}$$

Figure 14:
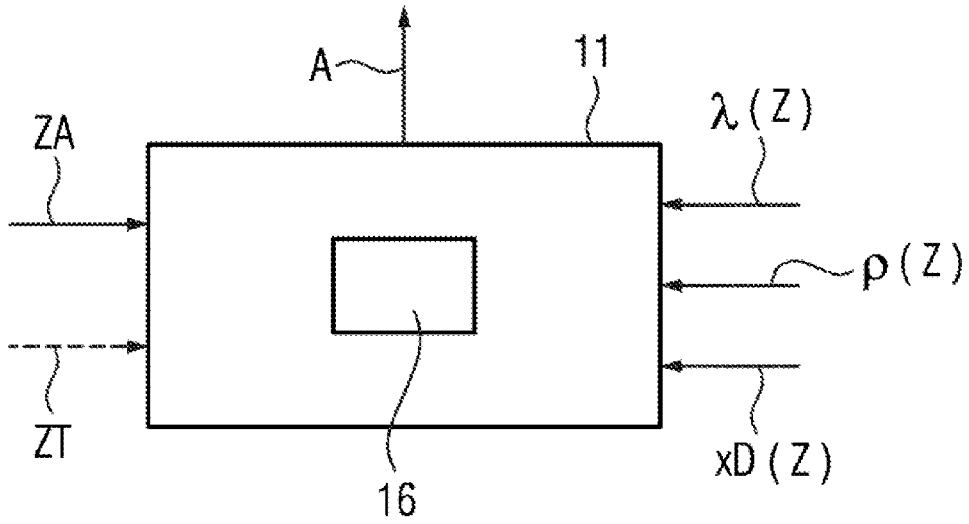
FIG. 14 shows a modification of the control device.
Figure 15:
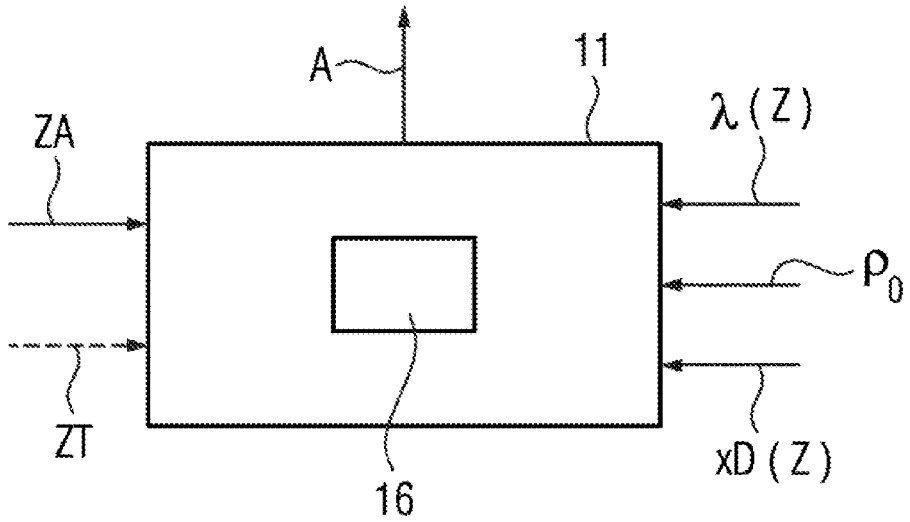
FIG. 15 shows a further modification of the control device.

In order to be able to determine the factor a', in accordance with FIG. 14, in addition to the thermal conductivity λ and the density ρ, the coefficient xD can be specified for the control device 11. If the rolling stock 1 behaves isotropically, it is furthermore possible, in the same way as in FIG. 11, to specify only the thermal conductivity λ and the density ρ for the control device 11, since in this case the control device 11 can independently determine the coefficient xD. Alternatively, in accordance with FIG. 15, it is possible to specify the coefficient xD for the control device 11 in addition to the thermal conductivity λ and the normalized density $\rho_0$.

In order to explain how to make an allowance correctly for the density ρ (dependent on the current state Z), a very specific heat conduction equation was taken as a basis above, namely the heat conduction equation in accordance with equation 8. As already mentioned, however, the way in which an allowance is made is independent of the heat conduction equation specifically used. For correctly making an allowance, it is therefore always necessary—depending on the procedure—to make an allowance for the factor a or the factor a', as indicated in equations 21, 23 and 25. This applies equally to the use of a one-dimensional, a two-dimensional and a three-dimensional heat conduction equation and equally to any kind of heat conduction equation. As likewise already mentioned, in conjunction with solving the heat conduction equation, in each case a phase transformation equation can be concomitantly solved as well, if necessary.

The technical application is always possible, in principle, if the temperature of the rolling stock 1 is intended to be modeled. Examples of corresponding situations have been explained thoroughly above in association with FIG. 3. However, other applications are also possible.

It is generally known to those skilled in the art that the heat conduction equation in accordance with equation 8 (this analogously also applies to other heat conduction equations) can be solved in real time. In this case, therefore, the modeling of the temporal development of the thermal state Z of the rolling stock 1 is effected in real time. This is the case for example for the procedures explained in association with FIGS. 3 and 4.

A solution online, i.e. although not in real time nevertheless with close temporal coupling to a real process, is also analogously possible. By way of example, an expected thermal initial state ZA and an expected temporal profile for the velocity v of the rolling stock 1 can be fed to the control device 11 in the context of a setup calculation, such that the control device 11 can determine beforehand what current thermal state Z is expected when the rolling stock 1 reaches the treatment device 2.

The requirements in respect of an implementation online are less stringent than the requirements in respect of an implementation in real time. Since an explanation has been given above as to how an implementation in real time is able to be realized, an implementation online is likewise possible.

The present invention has many advantages. In particular, even if the density ρ is state-dependent, an allowance can be made at least substantially correctly for the influence of the density ρ in the heat conduction equation. An improved modeling of the thermal behavior of the rolling stock 1 is possible as a result. By contrast, a shifting of support points for which the heat conduction equation is solved is not required.

Although the invention has been more specifically illustrated and described in detail by way of the preferred exemplary embodiment, nevertheless the invention is not restricted by the examples disclosed and other variants can be derived therefrom by a person skilled in the art without departing from the scope of protection of the invention.

LIST OF REFERENCE SIGNS

1 Rolling stock
2 Treatment device

3 Roughing stand
4 Finish rolling stand
5 Application devices
6, 8 Heating devices
7, 9 Descaling devices
10 Intermediate stand cooling facilities
11 Control device
12 Control program
13 Machine code
14 Portions
15, 17 Measuring devices
16 Model
18 Volume element
A Control
a, a' Factors
B, $B_0$ Widths
D, $D_0$, ds, $ds_0$ Thicknesses
H, $H_0$ Enthalpies or energy densities
j, $j_0$ Heat flow densities
L, $L_0$ Lengths
p Phase state
s Spatial variable in the thickness direction
S1 to S23 Steps
T, $T_0$ Temperatures
t Time
v Velocity
xL, xB, xD Coefficients
Z, ZA, ZT, Z0 Thermal states
$\lambda$, $\lambda_0$ Thermal conductivities
$\rho$, $\rho_0$ Densities

The invention claimed is:

1. A treatment method for an item of metal rolling stock, wherein the rolling stock is a flat hot item of rolling stock which extends in a longitudinal direction, in a width direction and in a thickness direction, wherein at a treatment time, the rolling stock is acted on at least substantially in the thickness direction by means of a treatment device, wherein at least for a period before the treatment time, the temporal development of a thermal state (Z) of the rolling stock is modelled by means of a model of the rolling stock (1) by iteratively solving at least one heat conduction equation, wherein control of the treatment device, taken as a basis for the treatment device to act on the rolling stock, is effected depending on that thermal state (Z) which is determined by means of the model for the rolling stock for the treatment time, wherein the density ($\rho$) of the rolling stock influences the heat conduction equation, wherein the density ($\rho$) is dependent on the respective thermal state (Z) of the rolling stock, wherein an allowance is made for the dependence of the density ($\rho$) of the rolling stock on the respective thermal state (Z) of the rolling stock in the heat conduction equation by a factor (a, a') of the form $$a = \frac{xL \cdot xB}{xD \cdot \rho_0} \text{ or } a' = \frac{1}{xD^2 \cdot \rho},$$

wherein $\rho$ and $\rho_0$ are densities ($\rho$, $\rho_0$) of the rolling stock related to a current and a predetermined thermal state (Z, Z0) of the rolling stock and the coefficients xL, xB and xD arise as a quotient of an extent (L, B, D, $L_0$, $B_0$, $D_0$) of the rolling stock in the longitudinal direction, in the width direction and in the thickness direction in the case of the respective and the predetermined thermal state (Z, Z0) of the rolling stock.

2. The treatment method as claimed in claim 1, wherein the coefficients xL, xB and xD are determined in such a way that they are mutually equal in magnitude and their product is equal to the quotient of the density ($\rho$) dependent on the respective thermal state (Z) of the rolling stock and the normalized density ($\rho_0$) related to the predetermined thermal state (Z0) of the rolling stock, or the coefficient xD is determined in such a way that it is equal to the cube root of the quotient of the density ($\rho$) dependent on the respective thermal state (Z) of the rolling stock and the normalized density ($\rho_0$) related to the predetermined thermal state (Z0) of the rolling stock.

3. The treatment method as claimed in claim 1, wherein the modeling of the temporal development of the thermal state (Z) of the rolling stock is effected online or in real time.

4. The treatment method as claimed in claim 1, wherein rolling of the rolling stock is effected by means of the treatment device, such that the thickness (D) of the rolling stock after the treatment device has acted on the rolling stock is smaller than before the treatment device has acted on the rolling stock.

5. The treatment method as claimed in claim 1, wherein, by means of the treatment device, purely thermal influencing of the rolling stock without conversion of the rolling stock is effected, in particular heating or cooling of the rolling stock.

6. A control program product for a control device of a treatment device for treating an item of metal rolling stock, wherein the control program product comprises machine code which is stored on a non-transitory computer-readable medium and is processable by the control device, wherein the processing of the machine code by the control device has the effect that the control device operates the treatment device in accordance with the treatment method as claimed in claim 1.

7. A control device of a treatment device for treating an item of metal rolling stock, wherein the control device is controlled by the control program of the control program product as claimed in claim 6 to operate the treatment device to perform the method in claim 6.

8. A treatment installation for treating an item of metal rolling stock, wherein the rolling stock is a flat hot item of rolling stock which extends in a longitudinal direction, in a width direction and in a thickness direction, wherein the treatment installation has a treatment device, by means of which the rolling stock (1) is able to be acted on at least substantially in the thickness direction, wherein the treatment installation has a control device, by which at least the treatment device is controlled, wherein the control device is designed as the control device of claim 7 to operate the treatment device to perform the method in claim 7.

* * * * *